US006386938B1

(12) United States Patent
Novak et al.

(10) Patent No.: US 6,386,938 B1
(45) Date of Patent: May 14, 2002

(54) SOUND-PRODUCING DEVICE

(76) Inventors: William R. Novak; Penny A. Novak, both of 3335 Trish Dr., Zephyrhills, FL (US) 33543

( * ) Notice: Subject to any disclaimer, the term of this patent is extended or adjusted under 35 U.S.C. 154(b) by 0 days.

(21) Appl. No.: 09/876,951

(22) Filed: Jun. 8, 2001

(51) Int. Cl.[7] ..... A63H 29/10; A63H 5/00; G10D 7/00

(52) U.S. Cl. ..... 446/186; 446/188; 446/202; 446/213; 446/397; 84/330; 84/349; 84/350

(58) Field of Search ..... 446/186, 188, 446/192, 193, 197, 202, 203, 204, 207, 224, 220, 213, 216, 397, 404; 84/330, 380 R, 349, 350, 83, 93

(56) References Cited

U.S. PATENT DOCUMENTS

| | | | | | |
|---|---|---|---|---|---|
| 1,313,705 | A | | 8/1919 | Lerch | |
| 1,703,463 | A | * | 2/1929 | Weigel | 446/186 |
| 1,760,022 | A | | 5/1930 | Stowe | |
| 2,608,795 | A | * | 9/1952 | Marcell | 446/186 |
| 2,636,315 | A | * | 4/1953 | Morsch | 446/187 |
| 2,677,213 | A | * | 5/1954 | Wechsler | 446/186 |
| 2,893,165 | A | | 7/1959 | Bailey | |
| 3,805,442 | A | * | 4/1974 | Matlack | 446/186 |
| 4,149,338 | A | * | 4/1979 | Wolf | 428/24 |
| 4,194,461 | A | | 3/1980 | Kubiatwoicz | |
| 4,560,392 | A | | 12/1985 | Basevi | |
| D300,271 | S | | 3/1989 | Rudolph | |
| 5,324,045 | A | * | 6/1994 | Trawick et al. | 137/223 |

* cited by examiner

*Primary Examiner*—Jacob K. Ackun
*Assistant Examiner*—Bena B. Miller

(57) ABSTRACT

A sound-producing device for producin a loud noise in support of one's team during sporting events. The sound-producing device includes an elongate tubular member having an open front end, an open back end, and a bore extending therethrough; and also includes a tubular spout being attached to and disposed through a wall of the elongate tubular member into the bore of the elongate tubular member and having an open end and a bore extending therethrough; and further includes a balloon being securely attached with a fastener to the open end of the tubular spout for holding and releasing air; and also includes an air intake valve member being disposed in the bore of the elongate tubular member to prevent release of air through the elongate tubular member; and further includes an air release member being disposed in the bore of the elongate tubular member to allow release of air through the open front end of the elongate tubular member; and also includes sound-producing flaps being opposedly and conventionally disposed in the bore of the elongate tubular member near the open front end thereof and being designed to vibrate and produce noise as air is released through the open front end of the elongate tubular member.

7 Claims, 4 Drawing Sheets

SOUND-PRODUCING DEVICE

BACKGROUND OF THE INVENTION

1. Field of the Invention

The present invention relates to air horns and more particularly pertains to a new sound-producing device for producing a loud noise in support of one's team during sporting events.

2. Description of the Prior Art

The use of air horns is known in the prior art. More specifically, air horns heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,560,392; U.S. Pat. No. 4,194,461; U.S. Pat. No. 1,760,022; U.S. Pat. No. 1,313,705; U.S. Pat. No. 2,893,165; and U.S. Pat. No. Des. 300,271.

While these devices fulfill their respective, particular objectives and requirements, the aforementioned patents do not disclose a new sound-producing device. The inventive device includes an elongate tubular member having an open front end, an open back end, and a bore extending therethrough; and also includes a tubular spout being attached to and disposed through a wall of the elongate tubular member into the bore of the elongate tubular member and having an open end and a bore extending therethrough; and further includes a balloon being securely attached with a fastener to the open end of the tubular spout for holding and releasing air; and also includes an air intake valve member being disposed in the bore of the elongate tubular member to prevent release of air through the elongate tubular member; and further includes an air release member being disposed in the bore of the elongate tubular member to allow release of air through the open front end of the elongate tubular member; and also includes sound-producing flaps being opposedly and conventionally disposed in the bore of the elongate tubular member near the open front end thereof and being designed to vibrate and produce noise as air is released through the open front end of the elongate tubular member.

In these respects, the sound-producing device according to the present invention substantially departs from the conventional concepts and designs of the prior art, and in so doing provides an apparatus primarily developed for the purpose of producing a loud noise in support of one's team during sporting events.

SUMMARY OF THE INVENTION

In view of the foregoing disadvantages inherent in the known types of air horns now present in the prior art, the present invention provides a new sound-producing device construction wherein the same can be utilized for producing a loud noise in support of one's team during sporting events.

The general purpose of the present invention, which will be described subsequently in greater detail, is to provide a new sound-producing device which has many of the advantages of the air horns mentioned heretofore and many novel features that result in a new sound-producing device which is not anticipated, rendered obvious, suggested, or even implied by any of the prior art air horns, either alone or in any combination thereof.

To attain this, the present invention generally comprises an elongate tubular member having an open front end, an open back end, and a bore extending therethrough; and also includes a tubular spout being attached to and disposed through a wall of the elongate tubular member into the bore of the elongate tubular member and having an open end and a bore extending therethrough; and further includes a balloon being securely attached with a fastener to the open end of the tubular spout for holding and releasing air; and also includes an air intake valve member being disposed in the bore of the elongate tubular member to prevent release of air through the elongate tubular member; and further includes an air release member being disposed in the bore of the elongate tubular member to allow release of air through the open front end of the elongate tubular member; and also includes sound-producing flaps being opposedly and conventionally disposed in the bore of the elongate tubular member near the open front end thereof and being designed to vibrate and produce noise as air is released through the open front end of the elongate tubular member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sound-producing device which has many of the advantages of the air horns mentioned heretofore and many novel features that result in a new sound-producing device which is not anticipated, rendered obvious, suggested, or even implied by any of the prior art air horns, either alone or in any combination thereof.

It is another object of the present invention to provide a new sound-producing device which may be easily and efficiently manufactured and marketed.

It is a further object of the present invention to provide a new sound-producing device which is of a durable and reliable construction.

An even further object of the present invention is to provide a new sound-producing device which is susceptible of a low cost of manufacture with regard to both materials and labor, and which accordingly is then susceptible of low prices of sale to the consuming public, thereby making such sound-producing device economically available to the buying public.

Still yet another object of the present invention is to provide a new sound-producing device which provides in the apparatuses and methods of the prior art some of the advantages thereof, while simultaneously overcoming some of the disadvantages normally associated therewith.

Still another object of the present invention is to provide a new sound-producing device for producing a loud noise in support of one's team during sporting events.

Yet another object of the present invention is to provide a new sound-producing device which includes an elongate tubular member having an open front end, an open back end, and a bore extending therethrough; and also includes a tubular spout being attached to and disposed through a wall of the elongate tubular member into the bore of the elongate tubular member and having an open end and a bore extending therethrough; and further includes a balloon being securely attached with a fastener to the open end of the tubular spout for holding and releasing air; and also includes an air intake valve member being disposed in the bore of the elongate tubular member to prevent release of air through the elongate tubular member; and further includes an air release member being disposed in the bore of the elongate tubular member to allow release of air through the open front end of the elongate tubular member; and also includes sound-producing flaps being opposedly and conventionally disposed in the bore of the elongate tubular member near the open front end thereof and being designed to vibrate and produce noise as air is released through the open front end of the elongate tubular member.

Still yet another object of the present invention is to provide a new sound-producing device that is easy and convenient to use.

Even still another object of the present invention is to provide a new sound-producing device that creates a loud noise without the user having to yell and cheer which can result in hoarseness.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
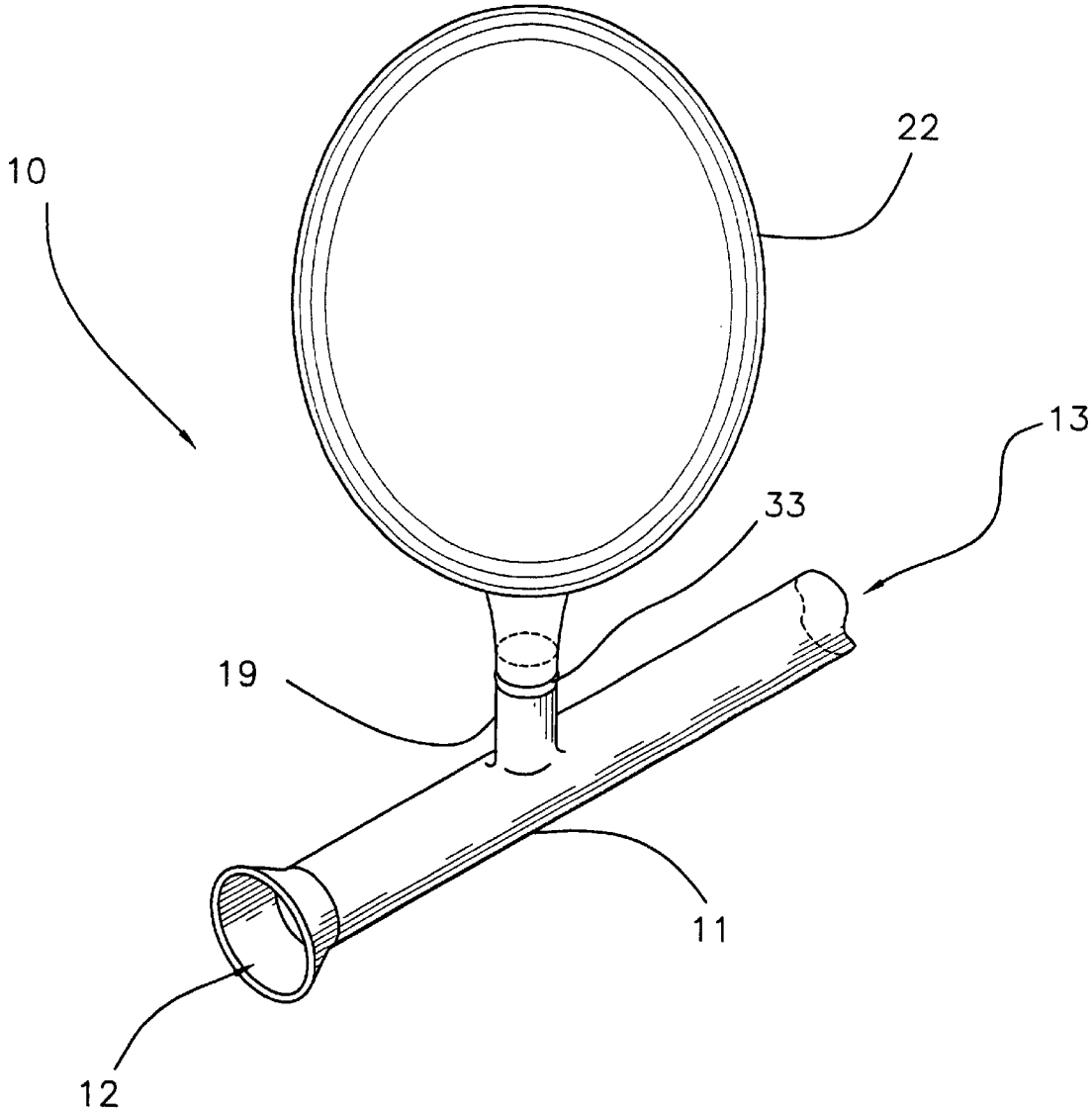
FIG. 1 is a front perspective view of a new sound-producing device according to the present invention.
Figure 2:
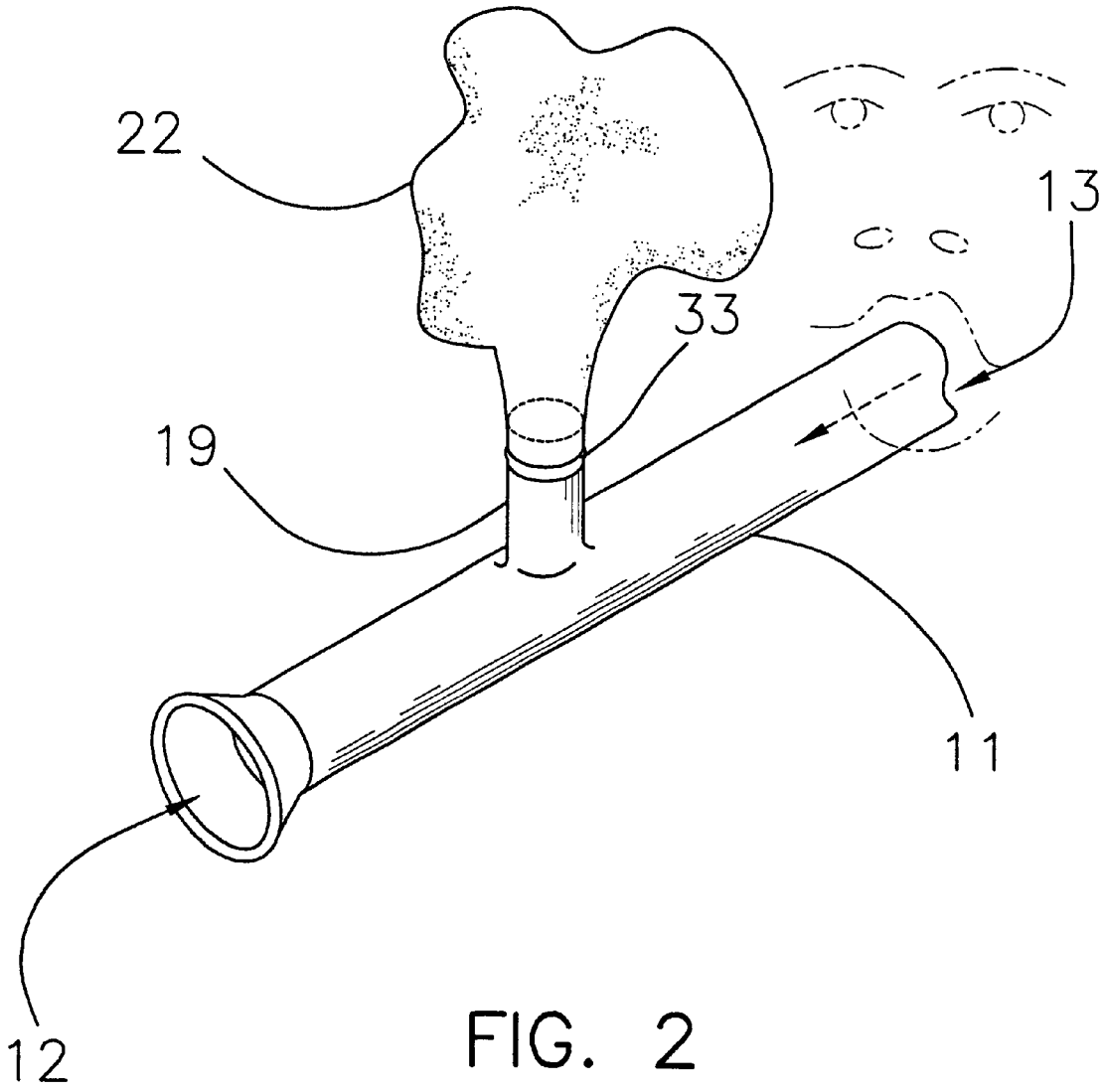
FIG. 2 is another front perspective view of the present invention with the balloon being deflated.
Figure 3:
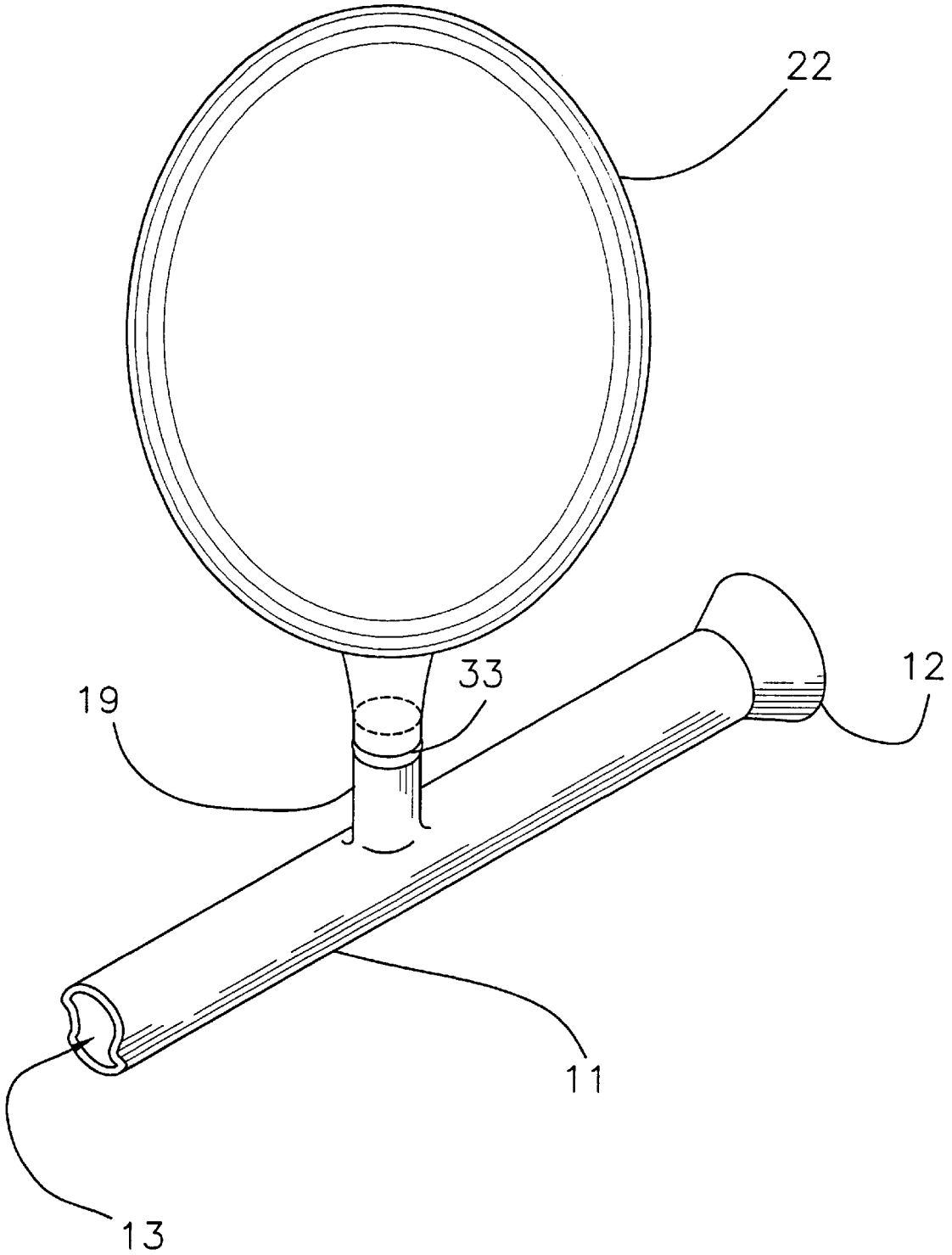
FIG. 3 is a rear perspective view of the present invention.
Figure 4:
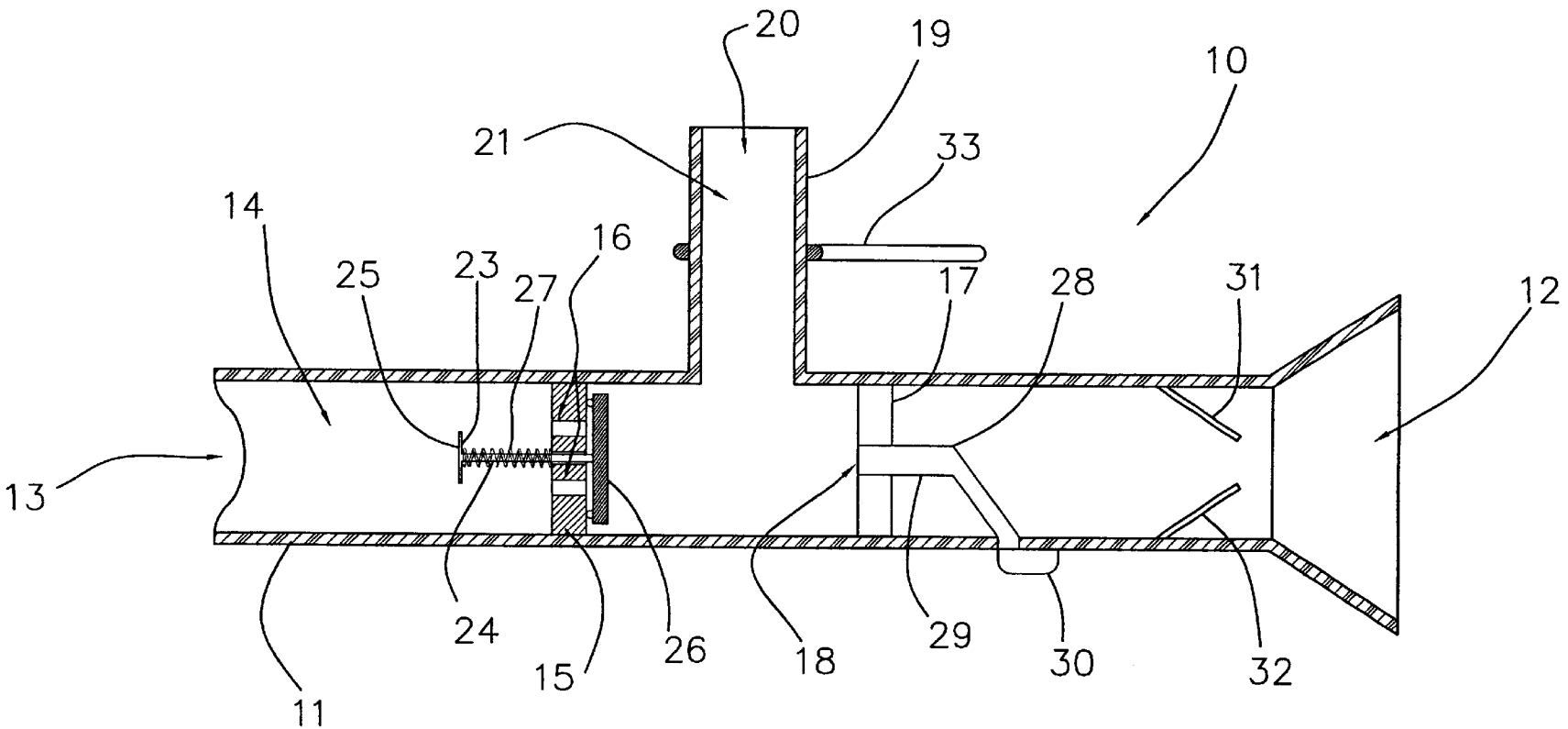
FIG. 4 is a side cross-sectional view of the present invention.

With reference now to the drawings, and in particular to FIGS. 1 through 4 thereof, a new sound-producing device embodying the principles and concepts of the present invention and generally designated by the reference numeral 10 will be described.

As best illustrated in FIGS. 1 through 4, the sound-producing device 10 generally comprises an elongate tubular member 11 having an open front end 12, an open back end 13, and a bore 14 extending therethrough. The elongate tubular member 11 further includes partitions 15,17 being securely and conventionally disposed in the bore 14 thereof. A tubular spout 19 is integrally attached to and disposed through a wall of the elongate tubular member 11 into the bore 14 of the elongate tubular member 11 and has an open end 20 and a bore 21 extending therethrough. The partitions 15,17 include a first partition 15 which is disposed between an opening to the tubular spout 19 and the back end 13 of the elongate tubular member 11, and also include a second partition 17 which is disposed between the opening to the tubular spout 19 and the front end 12 of the elongate tubular member 11. Each of the first and second partitions 15,17 has a hole 16,18 being disposed therethrough. The elongate tubular member 11 further includes a mouthpiece at the back end 13 thereof, and the front end 12 is conical-shaped and is flared outwardly. A balloon 22 is securely attached with a fastener 33 to the open end 20 of the tubular spout 19 for holding and releasing air.

An air intake valve member 23 is disposed in the bore 14 of the elongate tubular member 11 to prevent release of air through the elongate tubular member 11. The air intake valve member 23 includes a stem 24 being attached to the first partition 15 and has a flange 25 conventionally attached at an end thereof, and also includes a seal member 26 being movably closed over the at least one hole 16 through the first partition 15, and further includes a spring member 27 being disposed about the stem 24 and biasedly closing the seal member 26 over the at least one hole 16 through the first partition 15.

An air release member 28 is conventionally disposed in the bore 14 of the elongate tubular member 11 to allow release of air through the open front end 12 of the elongate tubular member 11. The air release member 28 includes an air outlet valve member 29 being attached to the second partition 17 over the hole 18 through the second partition 17, and also includes a lever 30 being conventionally attached to the air outlet valve member 29 and being disposed through the wall of the elongate tubular member 11 for releasing air stored in the balloon 22 through the open front end 12 of the elongate tubular member 11. Sound-producing flaps are opposedly and conventionally disposed in the bore of the elongate tubular member 11 near the open front end 12 thereof and designed to vibrate and produce noise as air is released through the open front end 12 of the elongate tubular member 11.

In use, the user blows up the balloon 22 by blowing air into the open back end 13 of the elongate tubular member 11 and al through the at least one hole 16 in the first partition 15. To produce noise, the user simply moves the lever 30 which opens the air outlet valve member 29 to allow air stored in the balloon 22 to be rush by the sound-producing flaps and through the open from end 12 of the elongate tubular member 11 thus causing noise.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A sound-producing device comprising:

an elongate tubular member having an open front end, an open back end, and a bore extending therethrough;

a tubular spout being attached to and disposed through a wall of said elongate tubular member into said bore of said elongate tubular member and having an open end and a bore extending therethrough;

a balloon being securely attached with a fastener to said open end of said tubular spout for holding and releasing air; and an air intake valve member being disposed in said bore of said elongate tubular member to prevent release of air through said elongate tubular member;

an air release member being disposed in said bore of said elongate tubular,member to allow release of air through said open front end of said elongate tubular member; and sound-producing flaps being opposedly and conventionally disposed in said bore of said elongate tubular member near said open front end thereof and being designed to vibrate and produce noise as air is released through said open front end of said elongate tubular member.

2. A sound-producing device as described in claim 1, wherein said elongate tubular member further includes partitions being securely disposed in said bore thereof.

3. A sound-producing device as described in claim 2, wherein said partitions include a first partition which is disposed between an opening to said tubular spout and said back end of said elongate tubular member, and also include a second partition which is disposed between said opening to said tubular spout and said front end of said elongate tubular member, each of said first and second partitions having a hole being disposed therethrough.

4. A sound-producing device as described in claim 3, wherein said elongate tubular member further includes a mouthpiece at said back end thereof, and said front end is conical-shaped and is flared outwardly.

5. A sound-producing device as described in claim 3, wherein said air intake valve member includes a tubular stem being attached to said first partition over said hole therethrough and having a bore extending therethrough, and also includes a seal member being movably closed over said hole through said first partition, and further includes a spring member being disposed in said tubular stem and biasedly closing said seal member over said hole through said first partition.

6. A sound-producing device as described in claim 3, wherein said air release member includes an air outlet valve member being attached to said second partition over said hole through said second partition, and also includes a lever being attached to said air outlet valve member and being disposed through said wall of said elongate tubular member for releasing air stored in said balloon through said open front end of said elongate tubular member.

7. A sound-producing device comprising:

an elongate tubular member having an open front end, an open back end, and a bore extending therethrough;

a tubular spout being attached to and disposed through a wall of said elongate tubular member into said bore of said elongate tubular member and having an open end and a bore extending therethrough, said elongate tubular member further including partitions being securely disposed in said bore thereof, said partitions including a first partition which is disposed between an opening to said tubular spout and said back end of said elongate tubular member, and also including a second partition which is disposed between said opening to said tubular spout and said front end of said elongate tubular member, each of said first and second partitions having a hole being disposed therethrough, said elongate tubular member further including a mouthpiece at said back end thereof, and said front end being conical-shaped and being flared outwardly;

a balloon being securely attached with a fastener to said open end of said tubular spout for holding and releasing air; and an air intake valve member being disposed in said bore of said elongate tubular member to prevent release of air through said elongate tubular member, said air intake valve member including a tubular stem being attached to said first partition over said hole therethrough and having a bore extending therethrough, and also including a seal member being movably closed over said hole through said first partition, and further including a spring member being disposed in said tubular stem and biasedly closing said seal member over said hole through said first partition;

an air release member being disposed in said bore of said elongate tubular member to allow release of air through said open front end of said elongate tubular member, said air release member including an air outlet valve member being attached to said second partition over said hole through said second partition, and also including a lever being attached to said air outlet valve member and being disposed through said wall of said elongate tubular member for releasing air stored in said balloon through said open front end of said elongate tubular member; and sound-producing flaps being opposedly and conventionally disposed in said bore of said elongate tubular member near said open front end thereof and being designed to vibrate and produce noise as air is released through said open front end of said elongate tubular member.

* * * * *